US009335118B1

(12) United States Patent
Jackson

(10) Patent No.: US 9,335,118 B1
(45) Date of Patent: May 10, 2016

(54) FIBER OPTIC WEAPON SIGHT

(71) Applicant: Jason Stewart Jackson, Omaha, NE (US)

(72) Inventor: Jason Stewart Jackson, Omaha, NE (US)

( * ) Notice: Subject to any disclaimer, the term of this patent is extended or adjusted under 35 U.S.C. 154(b) by 0 days.

(21) Appl. No.: 14/592,185

(22) Filed: Jan. 8, 2015

Related U.S. Application Data

(60) Provisional application No. 61/924,715, filed on Jan. 8, 2014.

(51) Int. Cl.
*F41G 1/00* (2006.01)
*F41G 1/34* (2006.01)

(52) U.S. Cl.
CPC ..... *F41G 1/345* (2013.01)

(58) Field of Classification Search
CPC ..... F41G 1/32; F41G 1/34; F41G 1/345; F41G 1/36; F41G 1/42; F41G 1/425
See application file for complete search history.

(56) References Cited

U.S. PATENT DOCUMENTS

| | | | | | |
|---|---|---|---|---|---|
| 1,292,211 | A | | 1/1919 | Young | |
| 1,423,184 | A | | 7/1922 | Butler | |
| 1,501,446 | A | | 7/1924 | French | |
| 1,982,058 | A | * | 11/1934 | King | F41G 1/02 42/144 |
| 2,352,644 | A | * | 7/1944 | Hibbard | F41G 11/00 351/158 |
| 2,596,522 | A | * | 5/1952 | Bethke | F41G 1/30 42/113 |
| 2,610,405 | A | | 9/1952 | Dickinson | |
| 2,706,335 | A | * | 4/1955 | Munsey | F41G 1/32 42/145 |
| 2,822,616 | A | | 2/1958 | Gang | |
| 2,925,657 | A | * | 2/1960 | Stenby | F41G 1/32 42/114 |
| 3,098,303 | A | | 7/1963 | Leonard | |
| 3,192,632 | A | | 7/1965 | Georg | |
| 3,218,718 | A | * | 11/1965 | Hays | F41G 1/32 250/467.1 |
| 3,362,074 | A | | 1/1968 | Luebkeman | |
| 3,524,710 | A | | 8/1970 | Rickert | |
| 3,552,819 | A | | 1/1971 | Mandler | |
| 3,555,687 | A | * | 1/1971 | Joseph | F41G 11/001 42/124 |
| 3,568,323 | A | | 3/1971 | Lendway | |
| 3,579,839 | A | | 5/1971 | Kowalski | |
| 3,641,676 | A | | 2/1972 | Knutsen | |
| 3,645,635 | A | | 2/1972 | Steck | |
| 3,678,590 | A | | 7/1972 | Hayward | |
| 3,698,092 | A | | 10/1972 | Rosenhan | |
| 3,700,339 | A | | 10/1972 | Steck, III | |
| 3,784,817 | A | | 1/1974 | Smiley | |
| 3,813,790 | A | | 6/1974 | Kaltmann | |
| 3,820,248 | A | | 6/1974 | Hayward | |
| 3,822,479 | A | | 7/1974 | Kowalski | |

(Continued)

OTHER PUBLICATIONS

Definition of "Contoured". <http://www.macmillandictionary.com/dictionary/american/contoured>. Macmillan Dictionary. 2009.*

(Continued)

*Primary Examiner* — Gabriel Klein

(57) ABSTRACT

The embodiments of the disclosed invention relate to fiber optic weapon sights that use a reflector to direct ambient light to a fiber optic rod, and thus can provide weapon sights that are bright, or at least visible, in a variety of lighting condition. In one instance, the reflector can have a concave shape, such as a spherical or parabolic shape, that can focus ambient light on the fiber optic rod and thereby significantly increase the brightness of the weapon sight. The embodiments of the present invention can accordingly provide enhanced fiber optic front and/or rear sights for weapons including rifles, pistols, and shotguns.

20 Claims, 6 Drawing Sheets

(56) References Cited

U.S. PATENT DOCUMENTS

| | | | |
|---|---|---|---|
| 3,911,607 | A | 10/1975 | Luebkeman |
| 3,914,873 | A | 10/1975 | Cresap |
| 3,937,968 | A | 2/1976 | Harris |
| 3,942,901 | A | 3/1976 | Ekstrand |
| 3,949,482 | A | 4/1976 | Ross |
| 3,961,423 | A | 6/1976 | Hrebar |
| 4,008,536 | A | 2/1977 | Adams |
| 4,030,203 | A | 6/1977 | Ackerman |
| 4,070,763 | A | 1/1978 | Carts |
| 4,143,465 | A | 3/1979 | White |
| 4,166,324 | A | 9/1979 | Carollo |
| 4,177,572 | A | 12/1979 | Hindes |
| 4,203,243 | A | 5/1980 | Hickman |
| 4,375,725 | A | 3/1983 | Orlob |
| 4,434,560 | A | 3/1984 | Comeyne |
| 4,494,327 | A | 1/1985 | Cullity |
| 4,495,705 | A | 1/1985 | Kowalski |
| 4,536,965 | A | 8/1985 | Tildeblad |
| 4,574,335 | A | 3/1986 | Frimer |
| 4,620,372 | A | 11/1986 | Goodrich |
| 4,628,611 | A | 12/1986 | Ruffino |
| 4,651,432 | A | 3/1987 | Bornancini |
| 4,665,622 | A | 5/1987 | Idan |
| 4,713,889 | A | 12/1987 | Santiago |
| 4,745,698 | A | 5/1988 | Schwulst |
| 4,805,313 | A | 2/1989 | Stocker |
| 4,806,007 | A | 2/1989 | Bindon |
| 4,819,611 | A | 4/1989 | Sappington |
| 4,877,324 | A | 10/1989 | Hauri |
| 4,899,479 | A | 2/1990 | Sanders |
| 4,918,823 | A | 4/1990 | Santiago |
| 4,928,394 | A | 5/1990 | Sherman |
| 4,934,784 | A | 6/1990 | Kapany |
| 4,993,158 | A | 2/1991 | Santiago |
| 5,001,837 | A | 3/1991 | Bray |
| 5,065,519 | A | 11/1991 | Bindon |
| 5,070,619 | A | 12/1991 | Santiago |
| 5,101,589 | A | 4/1992 | Duncan |
| 5,103,713 | A | 4/1992 | Loving |
| 5,121,462 | A | 6/1992 | Fabre |
| 5,168,540 | A | 12/1992 | Winn |
| 5,168,631 | A | 12/1992 | Sherman |
| 5,201,124 | A | 4/1993 | Sherman |
| 5,208,407 | A | 5/1993 | Stover |
| 5,231,765 | A | 8/1993 | Sherman |
| 5,279,061 | A | 1/1994 | Betz |
| 5,327,654 | A | 7/1994 | Parker |
| 5,359,800 | A | 11/1994 | Fischer |
| 5,442,861 | A | 8/1995 | Lorocco |
| 5,443,543 | A | 8/1995 | Epes |
| 5,638,604 | A | 6/1997 | Lorocco |
| 5,653,034 | A | 8/1997 | Bindon |
| D393,306 | S | 4/1998 | Couper |
| 5,735,070 | A | 4/1998 | Vasquez |
| 5,836,100 | A | 11/1998 | Stover |
| 5,878,503 | A | 3/1999 | Howe |
| 5,887,352 | A | 3/1999 | Kim |
| 5,894,672 | A | 4/1999 | Ellenburg |
| 5,901,452 | A | 5/1999 | Clarkson |
| 5,926,963 | A | 7/1999 | Knight |
| 5,930,906 | A | 8/1999 | Howe |
| 5,956,854 | A | 9/1999 | Lorocco |
| 6,014,830 | A | 1/2000 | Brown |
| 6,016,608 | A | 1/2000 | Lorocco |
| 6,035,539 | A | 3/2000 | Hollenbach |
| 6,058,615 | A | 5/2000 | Uhlmann |
| 6,085,427 | A | 7/2000 | Persson |
| 6,122,833 | A | 9/2000 | Lorocco |
| 6,216,351 | B1 | 4/2001 | Flubacher |
| 6,216,352 | B1 | 4/2001 | Lorocco |
| 6,230,414 | B1 | 5/2001 | Glock |
| 6,233,836 | B1 | 5/2001 | Uhlmann |
| 6,360,472 | B1 | 3/2002 | Lorocco |
| 6,421,946 | B1 | 7/2002 | Lorocco |
| 6,446,377 | B1 | 9/2002 | Hollenbach |
| 6,449,419 | B1 | 9/2002 | Brough |
| 6,568,119 | B2 | 5/2003 | Schoemaker |
| 6,571,482 | B1 | 6/2003 | Tymianski |
| 6,571,504 | B2 | 6/2003 | Carlson |
| 6,581,317 | B1 | 6/2003 | Slates |
| 6,640,482 | B2 | 11/2003 | Carlson |
| 6,678,987 | B2 | 1/2004 | Howe |
| 6,684,551 | B2 | 2/2004 | Howe |
| 6,775,942 | B2 | 8/2004 | Compton |
| 6,817,105 | B2 | 11/2004 | Lorocco |
| 6,860,056 | B2 | 3/2005 | Howe |
| 7,287,351 | B1 | 10/2007 | Warren |
| 7,562,486 | B2 | 7/2009 | Lorocco |
| 7,627,976 | B1 | 12/2009 | Olson |
| 7,652,818 | B2 | 1/2010 | Wagner |
| 7,676,981 | B2 | 3/2010 | Buckingham |
| 7,743,546 | B2 | 6/2010 | Keng |
| 7,886,475 | B2 | 2/2011 | Dubois |
| 7,908,783 | B2 | 3/2011 | Howe |
| 8,161,675 | B2 | 4/2012 | Sne |
| 8,189,967 | B1 | 5/2012 | Olson |
| 8,230,637 | B2 | 7/2012 | Lamb |
| 8,245,433 | B1 | 8/2012 | Smith |
| 8,438,775 | B2 | 5/2013 | Howe |
| 8,579,450 | B2 | 11/2013 | Profos |
| 8,607,495 | B2 | 12/2013 | Moore |
| 8,635,800 | B2 | 1/2014 | Glimpse |
| 8,635,801 | B2 | 1/2014 | Glimpse et al. |
| 8,656,627 | B2 | 2/2014 | Howe |
| 8,656,631 | B2 | 2/2014 | Koesler |
| 8,677,674 | B2 | 3/2014 | Glimpse |
| 8,739,454 | B2 | 6/2014 | Erdle |
| 8,813,413 | B2 | 8/2014 | Howe |
| 8,925,237 | B2 | 1/2015 | Howe |
| 8,925,238 | B2 | 1/2015 | Anderson |
| 2002/0073597 | A1* | 6/2002 | LoRocco ..... F41G 1/16 42/111 |
| 2003/0079396 | A1 | 5/2003 | Brown |
| 2005/0016052 | A1 | 1/2005 | Nattrass |
| 2006/0123687 | A1 | 6/2006 | Howe |
| 2007/0107292 | A1 | 5/2007 | Bar-Yona |
| 2010/0088944 | A1 | 4/2010 | Callihan |
| 2010/0212208 | A1 | 8/2010 | Sims |
| 2011/0107650 | A1* | 5/2011 | Howe ..... F41G 1/10 42/132 |
| 2012/0186129 | A1 | 7/2012 | Sne et al. |
| 2013/0097881 | A1 | 4/2013 | Profos |
| 2014/0109460 | A1* | 4/2014 | Howe ..... F41G 1/08 42/132 |
| 2014/0259855 | A1 | 9/2014 | Abo |
| 2014/0317989 | A1 | 10/2014 | Lee |
| 2015/0109602 | A1* | 4/2015 | Martin ..... F41G 1/345 356/3 |

OTHER PUBLICATIONS

HI VIZ Shooting Systems 2013 Product Catalog.

Taran Tactical Ultimate Fiber Optic Sights Set for Glock. Retrieved from the Internet: <http://www.shootersconnectionstore.com/Taran-Tactical-Ultimate-Fiber-Optic-Sights-Set-for-GLOCK-P2840.aspx>.

TRUGLO 3/8" Metal Dovetail Sights. Retrieved from the Internet: <http://www.truglo.com/firearms-rifle/3-8-inch-metal-dovetail-sights.asp>.

TRUGLO Airgun Globe Sights. Retrieved from the Internet: <http://www.truglo.com/firearms-air-guns/airgun-globe-sights.asp>.

TRUGLO Brite•Site Fiber-Optic Sights. Retrieved from the Internet: <http://www.truglo.com/firearms-handgun/brite-site-fiber-optic-handgun-sights.asp>.

TRUGLO Brite•Site TFO. Retrieved from the Internet: <http://www.truglo.com/firearms-handgun/brite-site-tritium-fiber-optic-handgun-sights-green-green.asp>.

TRUGLO Fat•Bead Dual•Color. Retrieved from the Internet: <http://www.truglo.com/firearms-wing-shooting/fat-bead-dual-color.asp>.

TRUGLO Fat•Bead. Retrieved from the Internet: <http://www.truglo.com/firearms-wing-shooting/fat-bead-and-fat-bead-universal.asp>.

(56) References Cited

OTHER PUBLICATIONS

TRUGLO Fiber Optic AR15 Style Front Gas Block Sight. Retrieved from the Internet: <http://www.truglo.com/firearms-tactical/fiber-optic-ar15-style-front-gas-block-sight.asp>.

TRUGLO Home Defense Fiber Optic Universal Shotgun Sight. Retrieved from the Internet: <http://www.truglo.com/firearms-hand-gun/home-defense-fiber-optic-universal-shotgun-sight.asp>.

TRUGLO Rimfire Pistol Fiber Optic Front Sight. Retrieved from the Internet: <http://www.truglo.com/firearms-handgun/rimfire-pistol-fiber-optic-front-sight.asp>.

TRUGLO TFO AR15 Style Front Sight. Retrieved from the Internet: <http://www.truglo.com/firearms-tactical/tritium-fiber-optic-ar15-style-front-sight.asp>.

TRUGLO TFO Shotgun Front Sight. Retrieved from the Internet: <http://www.truglo.com/firearms-tactical/tritium-fiber-optic-shot-gun-front-sight.asp>.

TRUGLO Tru•Bead Universal. Retrieved from the Internet: <http://www.truglo.com/firearms-wing-shooting/tru-bead-universal.asp>.

* cited by examiner

FIBER OPTIC WEAPON SIGHT

CROSS-REFERENCE TO RELATED APPLICATIONS

This application claims priority to U.S. Provisional Application Ser. No. 61/924,715, filed Jan. 8, 2014, which is herein incorporated by reference in its entirety.

SUMMARY OF THE INVENTION

The various embodiments of the present invention relate to fiber optic weapon sights that direct ambient or environmental light onto a fiber optic rod to provide a brighter sight.

Accordingly, embodiments of the present invention can provide a weapon sight comprising a light receptor and a reflective surface that is shaped to reflect ambient light to the light receptor. The weapon sight can further include a sight body having a length and a long axis, and a width and a lateral axis. The light receptor can be parallel to the length or long axis of the sight body, and/or positioned along the length of the sight body. Additional embodiments can provide a weapon sight including a body means, a receptor means, and a reflector means.

The sight body of any embodiment of the present invention can include a rear or first protrusion. The rear protrusion can include a rear face that faces a shooter. The rear face can be rectangular and/or curved such as for use with a post- and notch-type sight. The rear protrusion can comprise a post that has the same width as the sight body, or it can be narrower, or wider, than the sight body. The rear protrusion can be positioned at the rear end of the sight body, or inside the rear end of the sight body. The sight body of embodiments of the present invention can also include a front or second protrusion. The front protrusion can include a front face. The front face can be rectangular and/or curved. The front protrusion can comprise a post that has the same width as the sight body, or it can be narrower, or wider, than the sight body. The front protrusion can be positioned at the front end of the sight body, or inside the front end of the sight body. The front and rear protrusions can have the same, or a different, height, width, and/or shape.

Further embodiments of the present invention can provide a weapon sight including a sight body. The sight body can include a concave reflector that is shaped to reflect ambient light to a fiber optic rod. The sight can further include a front protrusion coupled to the sight body and including a front mounting point for positioning a front end of the fiber optic rod, and a rear protrusion coupled to the sight body and including a rear mounting point for positioning a rear end of the fiber optic rod.

The reflective surface or reflector of any embodiment of the present invention can comprise one or more curved shapes or surfaces and/or one or more flat shapes or surfaces. The one or more flat shapes or surfaces can have normals that direct light to a light receptor. A curved shape can comprise a concave shape including, but not limited to, a spherical or parabolic shape. The reflective surface of embodiments of the present invention can include a focus through which reflected light passes, such as when the reflective surface comprises a spherical or parabolic shape. The focus of any embodiment of the present invention can be incident at any point, including below, above, or on, a light receptor. For example, the focus can be incident on a center of a long axis of a light receptor, or the focus can be incident on a point between an axial center and a top of a light receptor.

The reflective surface of any embodiment of the present invention can comprise a surface of the sight body. In further embodiments the reflective surface can comprise one of a coating, layer, tape, and plating on a surface of the sight body. The reflector in further embodiments can comprise a reflector body that can be permanently or detachably coupled to the sight body. A detachable reflector body can be useful to assist in cleaning, for example. The reflector body can be coupled to the sight body using at least one of a press fit, a spring-loaded detent, a pin, a screw, and an adhesive.

An intersection of a reflector's focus and a light receptor can be determined using an angle of reflection of one or more rays reflected from the reflector, and/or an angle of incidence of one or more reflected rays striking the light receptor. In addition, or in the alternative, an intersection of a focus and a light receptor can be determined using a spherical aberration of the reflective surface when the reflector comprises a spherical reflector.

Further embodiments of the present invention can include a light source that provides light to a light receptor. For example, a light source can comprise a tritium vial or lamp to direct light into a side and/or end of a light receptor. In other embodiments a battery-powered light source, such as an LED, can be used and can be positioned to direct light into a side and/or end of a light receptor. In further embodiments a light source can comprise a glow-in-the-dark paint, tape, or coating.

Additional embodiments of the present invention can provide a weapon sight comprising a sight body for an open-type sight. The sight body can include, or be coupled to, one or more mounting points for securing a light receptor to the sight body. For example, a sight body can include a rear protrusion including a rear bore and a front protrusion including a front bore. The sight can also include a light receptor such as a fiber optic rod inserted in the front bore and in the rear bore and positioned along a length of the sight body. The sight can further include a concave, such as spherical or parabolic, reflector that directs light to the fiber optic rod. The focus of the concave reflector can be incident on the fiber optic rod.

Further embodiments of the present invention can provide a weapon sight comprising a rear sight. The rear sight can include a rear sight body, a left light receptor coupled to a left side of the rear sight body, a left reflective surface that directs light to the left light receptor, a right light receptor coupled to a right side of the rear sight body, and a right reflective surface that directs light to the right light receptor.

Other embodiments of the present invention can provide a rear sight including a body means, a left receptor means, a left reflector means, a right reflector means, and a right receptor means.

Further embodiments of the present invention can provide a sight system including a front sight and a rear sight. The front sight can comprise a front sight body, a front light receptor coupled to the sight body, and a front reflective surface that directs light to the front light receptor The rear sight can comprise a rear sight body, a left light receptor coupled to a left side of the rear sight body, a left reflective surface that directs light to the left light receptor, a right light receptor coupled to a right side of the rear sight body, and a right reflective surface that directs light to the right light receptor. Embodiments of the present invention can thus provide a "three dot" sight picture.

Other embodiments of the present invention can provide a sight system including a front sight means and a rear sight means. The front sight means can comprise a body means, a receptor means coupled to the body means, and a reflector means. The rear sight means can comprise a body means, a left receptor means, a left reflector means, a right reflector means, and a right receptor means.

Further embodiments of the present invention can provide methods for manufacturing a weapon sight. The methods can comprise the steps of making a sight base that includes a reflective surface for directing light to a light receptor, and making one or more mounting points coupled to the sight base for securing the light receptor to the sight base and for positioning the light receptor to receive reflected light from the reflective surface. The methods can further comprise the step of securing the light receptor to the sight base using the one or more mounting points.

Additional embodiments of the present invention can provide methods for installing a weapon sight. The methods can comprise the step of obtaining a sight base, the sight base including a reflective surface for directing light to a light receptor and one or more mounting points for securing the light receptor to the sight base. The methods can further comprise the steps of coupling the light receptor to the sight base using the one or more mounting points, and attaching the sight base to a weapon.

One of skill in the art will understand that any feature, element, or characteristic of any embodiment of the present invention can be used or combined with any feature, element, or characteristic of any other embodiment of the present invention. Unless otherwise expressly stated, it is in no way intended that any method or embodiment set forth herein be construed as requiring that its steps or actions be performed in a specific order. Accordingly, where a method, system, or apparatus claim for example does not specifically state in the claims or descriptions that the steps are to be limited to a specific order, it is no way intended that an order be inferred, in any respect. This holds for any possible non-express basis for interpretation, including matters of logic with respect to arrangement of steps or operational flow, plain meaning derived from grammatical organization or punctuation, or the number or type of embodiments described in the specification.

BRIEF DESCRIPTION OF THE DRAWINGS

The accompanying drawings, which are incorporated in and constitute part of this specification, illustrate embodiments of the invention, and together with the description, serve to explain the principles of various embodiments of the invention. The embodiments described in the drawings and specification in no way limit or define the scope of any embodiment or claim of the present invention.

Figure 1A:
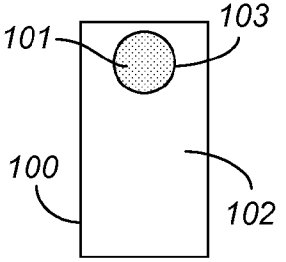
FIG. 1A is rear view of a front sight of one embodiment of the present invention.

The embodiments of the present invention have been illustrated in all respects to be illustrative rather than restrictive. For example, a person skilled in the art will understand that the elements in the drawings are not limited to the specific dimensions shown, but are for illustrative purposes only. Those skilled in the art will further realize that the embodiments of the present invention are capable of many modifications and variations without departing from the scope of the present invention.

DESCRIPTION OF THE INVENTION

The embodiments of the present invention generally relate to weapon sights and assemblies, systems, and methods that include or comprise a light receptor, such as a fiber optic ("FO") rod, and a reflective surface for directing ambient light to the light receptor. Use of a reflector as described in connection with the disclosed embodiments can provide a sight with enhanced visibility in all light conditions.

The weapon sight embodiments of the present invention can comprise a front or a rear sight for one of a pistol, rifle, shotgun, and air rifle, for example, and preferably can comprise a front or a rear sight of an open- or iron-type sight such as one of a U-notch and post, Patridge, V-notch and post, Express, U-notch and bead, V-notch and bead, bead, trapezoid, peep, and ghost ring sight. The embodiments of the present invention may also be used with other types of weapon sights including red dot sights, magnified optical sights, and the like. The embodiments of the present invention can also be used as a sight for other types of weapons including bows, cross bows, and sling shots, as well as for toy or replica weapon sights.

Figure 1B:
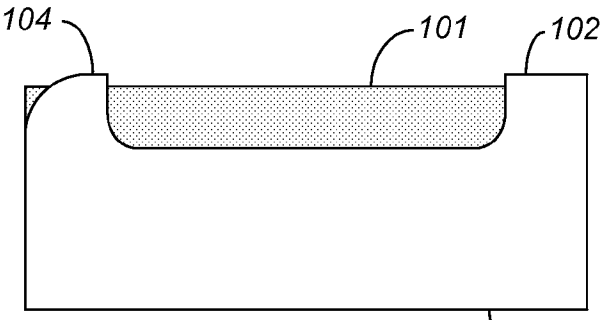
FIG. 1B is a side view of the front sight of FIG. 1.

Accordingly, embodiments of the present invention can provide a weapon sight for a blade-type front sight comprising a sight body, a light receptor coupled to the sight body, and a reflective surface that directs light to the light receptor. FIG. 1 shows one such embodiment. FIG. 1A shows a rear or shooter-facing view of the sight of FIG. 1, and shows a front sight body (100) having a rear protrusion (102) and a light receptor (101) comprising a FO rod. The FO rod (101) is located in the rear bore (103) of the rear protrusion (102). FIG. 1B provides a side view of the embodiment of FIG. 1 and shows the sight body (100) including the rear protrusion (102) and a front protrusion (104). The FO rod (101) is shown secured to the sight body (100) using the rear protrusion (102) and the front protrusion (104).

Figure 1C:
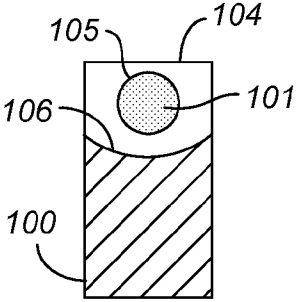
FIG. 1C is a lateral cross-sectional view of the front sight of FIG. 1.

FIG. 1C shows a lateral cross-sectional view of the front sight of FIG. 1 as shown from the rear of the sight, and shows the light receptor (101) located in the front bore (105) of the front protrusion (104) and positioned above the reflector (106). FIG. 1D shows a longitudinal cross-sectional view of the front sight of FIG. 1 and similarly shows the light receptor (101) located in the front bore (105) of the front protrusion (104) and in the rear bore (103) of the rear protrusion (102) and positioned above the reflector (106).

As can be envisioned with respect to FIG. 1C (which is for illustrative purposes only and not necessarily drawn to scale), the light receptor (101) can intersect the focal point of the reflector (106). For a spherical reflector, the focus is located at one-half of the spherical radius. Regarding parabolic reflectors, an equation for a concave-up parabola located at the origin of a coordinate system (which can be considered the bottom point or vertex of a parabolic reflector of the disclosed embodiments) is $y=ax^2$, with the focus located at ¼a.

By placing the light receptor (101) on or about the focus, it may receive most or all of light that is reflected by the spherical reflector (106) depending on the lighting conditions. By way of example, consider that a light source is located directly above and far away from the sight, such as the sun. In that instance, the reflected rays will pass through the focus of the reflector. The light reflected from the reflector (106) to the focus is proportional to the arc length of the reflector (106), which can be significantly greater than the width of the light receptor (101). Accordingly, by placing the FO rod (101) on or about the focus, the FO rod (101) may receive significantly more light that it would without the reflector (106), and thus the ends of the FO rod (101) will glow more brightly than they would without the reflector (101).

Figure 1D:
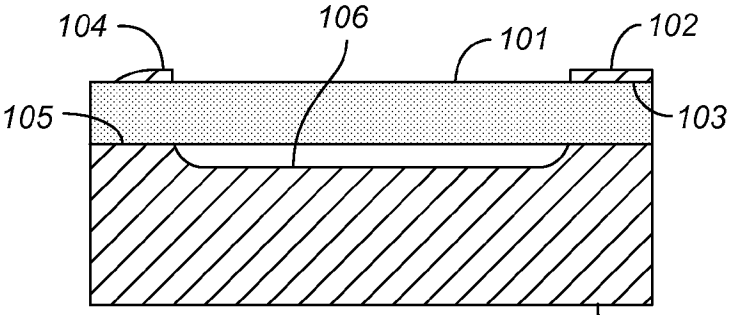
FIG. 1D is a longitudinal cross-sectional view of the front sight of FIG. 1.

As shown in FIG. 1D, the light receptor mounting points of any embodiment of the present invention can comprise one or more bores, and those bores may be co-axial and parallel to the reflector (106). It should be noted, however, that the one or more bores need not be co-axial, and that when they are, they need not be parallel to the reflector. Thus, in the instance where co-axial bores are not parallel to the reflector, for example, the focus of the reflector could intersect a light receptor at different points along a length of the receptor.

Figure 1E:
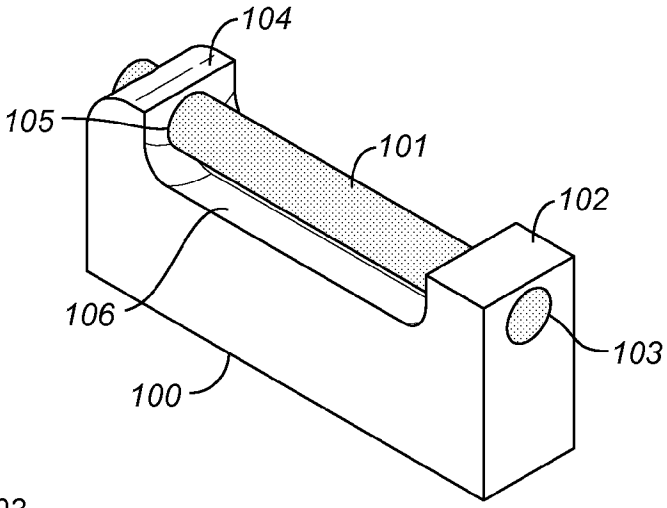
FIG. 1E is a perspective view of the front sight of FIG. 1.

FIG. 1E shows a perspective view of the front sight of FIG. 1 and shows the light receptor (101) located in the front bore (105) of the front protrusion (104) and in the rear bore (103) of the rear protrusion (102) and positioned above the reflector (106). As shown in FIGS. 1C and 1E, for example, the reflector (106) can span the width of the sight body (100) in embodiments of the present invention. In other embodiments, the reflector does not span the full width of the sight body, nor must the reflector span the available length of the sight body between one or more mounting points. As can be envisioned with respect to FIG. 1E, the reflector (106) can comprise a plurality of surfaces, including a cylindrical hemispherical reflector as well as one or more additional surfaces, such as the curved areas where the reflector (106) meets front (104) and rear (102) protrusions.

In various embodiments of the present invention a light receptor, such as a FO rod, can protrude beyond, be flush with, or be recessed with respect to a mounting point such as a bore. In further embodiments the sight body can have a dark coloring such as by cold or hot bluing, by painting, by phosphating, or by plating, for example.

As shown in FIG. 1, the rear protrusion (102) can have a rectangular shape and the front protrusion (104) can have a rectangular shape with a curved upper edge. None of the embodiments disclosed herein are limiting to protrusions having those particular shapes as shown, for example, in FIGS. 3 and 4.

Further embodiments of the present invention can provide rear sights or rear sight assemblies, and those sights can be used or combined with any embodiment of the present invention. By way of example, one embodiment of the present invention comprising an open-type rear sight is shown in FIG. 2. The rear sight shown in FIG. 2 can be used with any of the front sight embodiments disclosed herein, including, but not limited to, those embodiments described with respect to FIGS. 1 and 3-5.

Figure 2A:
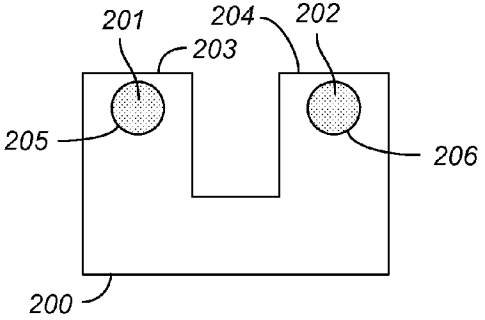
FIG. 2A is rear view of a rear sight of one embodiment of the present invention.
Figure 2B:
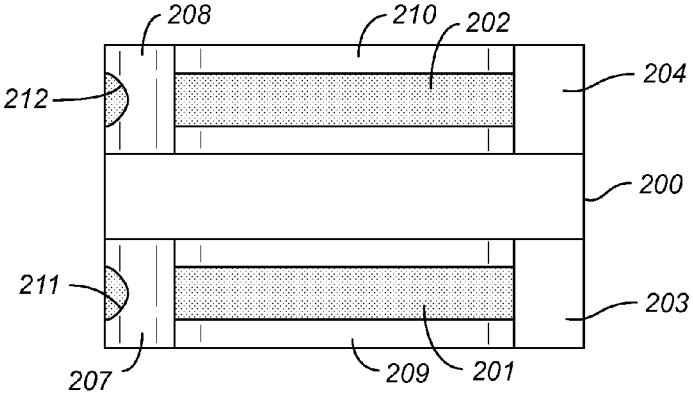
FIG. 2B is a top view of the rear sight of FIG. 2.

FIG. 2A is a rear view of the rear sight of FIG. 2 and shows the sight body (200), a left light receptor (201) located in a rear left bore (205) of a rear left protrusion (203), and a right light receptor (202) located in a rear right bore (206) of a rear right protrusion (204). FIG. 2B provides a top-down view of the rear sight of FIG. 2 and shows the sight body (200), a left light receptor (201) located in a front left bore (211) of a front left protrusion (207), and a right light receptor (202) located in a front right bore (212) of a front right protrusion (208). Thus right light receptor (202) is positioned above the right reflector (210) using co-axial bores (206, 212), and the left light receptor (201) is positioned above the left reflector (209) using co-axial bores (205, 211).

As can be seen in FIG. 2, the front sights of the present invention, like the sight shown in FIG. 1, can be used to create rear sight embodiments of the present invention by using two of said front sight assemblies. In addition to the embodiments disclosed with respect to FIG. 1, any of the front sights disclosed herein can be used to create rear sight embodiments of the present invention, including, but not limited to, the front sights disclosed with respect to FIGS. 3-5.

Figure 2C:
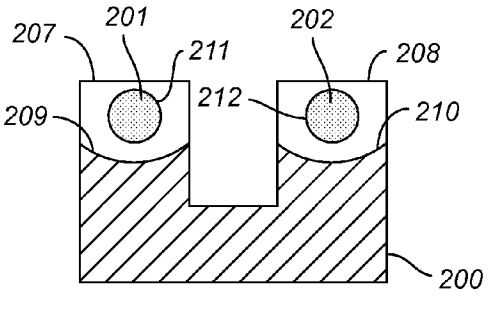
FIG. 2C is a lateral cross-sectional view of the rear sight of FIG. 2.

FIG. 2C is a lateral cross-sectional view of the rear sight of FIG. 2 as shown from the rear of the sight, and shows the left light receptor (201) located in the front left bore (211) of the front left protrusion (207) and positioned above the left reflector (209). FIG. 2C also shows the right light receptor (202) located in the front right bore (212) of the front right protrusion (208) and positioned above the right reflector (210).

Figure 2D:
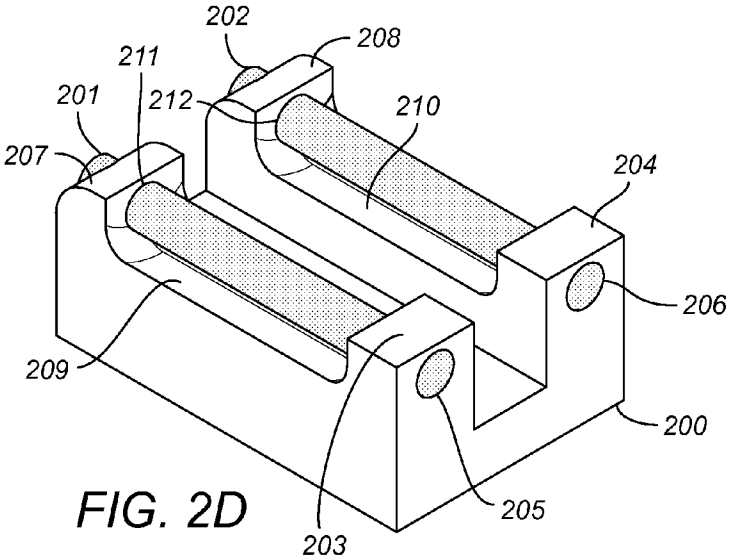
FIG. 2D is a perspective view of the rear sight of FIG. 2.

FIG. 2D shows a perspective view of the rear sight of FIG. 2 and shows the left light receptor (201) located in the front bore (211) of the front left protrusion (207) and in the rear bore (205) of the left rear protrusion (203) and positioned above the left reflector (209). It further shows the right light receptor (202) located in the front bore (212) of the front right protrusion (208) and in the rear bore (206) of the right rear protrusion (204) and positioned above the right reflector (210).

Further embodiments of the present invention can provide a weapon sight for a post- or bead-type front sight. Said embodiments can comprise a sight body, a light receptor coupled to the sight body, and a reflective surface that directs light to the light receptor. FIG. 3 shows one such embodiment. FIG. 3A shows a rear or shooter-facing view of the sight of FIG. 3, and shows a front sight body (300) including a rear protrusion (302) and a light receptor (301) that can comprise a FO rod. The light receptor (301) is located in the rear bore (303) of the rear protrusion (302). FIG. 3B provides a side view of the embodiment of FIG. 3 and shows the sight body (300) including the rear protrusion (302) and the front protrusion (304). The FO rod (301) is shown suspended between the rear protrusion (302) and the front protrusion (304).

Figure 3E:
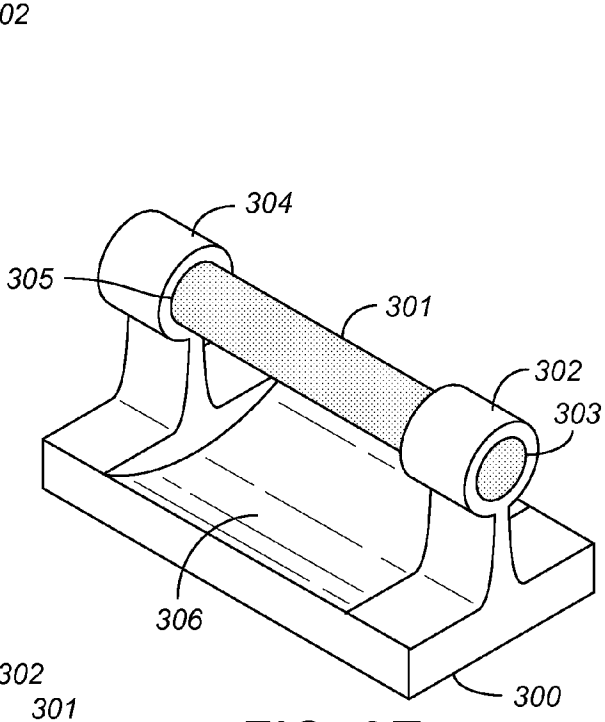
FIG. 3E is a perspective view of the front sight of FIG. 3.
Figure 3B:
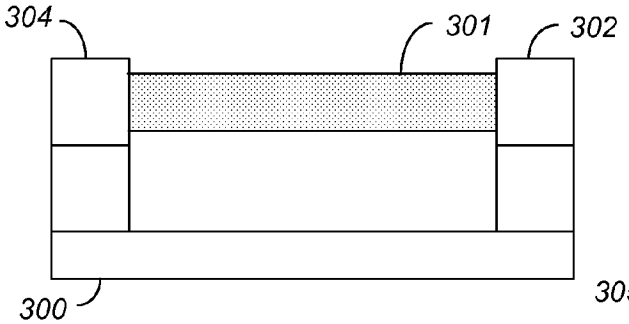
FIG. 3B is a side view of the front sight of FIG. 3.
Figure 3D:
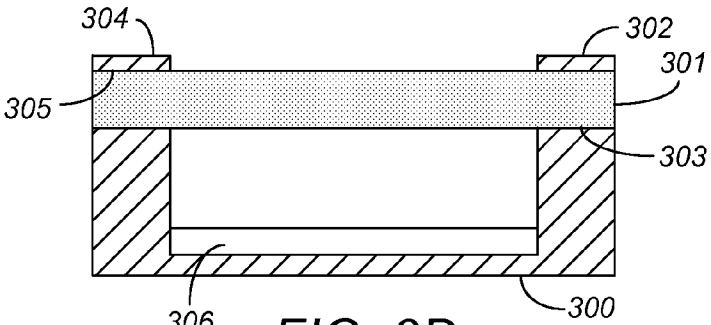
FIG. 3D is a longitudinal cross-sectional view of the front sight of FIG. 3.
Figure 3A:
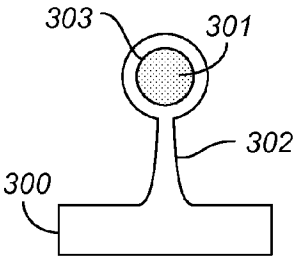
FIG. 3A is rear view of a front sight of another embodiment of the present invention.
Figure 3C:
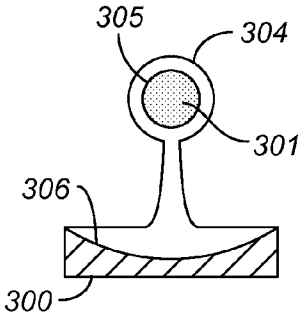
FIG. 3C is a lateral cross-sectional view of the front sight of FIG. 3.

FIG. 3C show a lateral cross-sectional view of the front sight of FIG. 3 as shown from the rear of the sight, and shows the light receptor (301) located in the front bore (305) of the front protrusion (304) and positioned above the reflector (306). FIG. 3D shows a longitudinal cross-sectional view of the front sight of FIG. 3 and shows the light receptor (301) located in the front bore (305) of the front protrusion (304) and in the rear bore (303) of the rear protrusion (302) and positioned above the reflector (306).

As shown by way of example in FIGS. 1 and 3, an outer edge of a reflector can have any suitable height with respect to a light receptor. As shown in FIG. 1, for example, the bottom (or lower edge as seen from the side) of a light receptor (101) can be of the same height as an outer edge of a reflector (106). As shown in FIG. 3, for example, the bottom of a light receptor (301) can be above an outer edge of a reflector (306). In further embodiments, the outer edge of a reflector can be above a lower edge of a light receptor, or even above an upper edge of a light receptor. The height of the outer edge of a reflector can be increased, for example, to provide a light receptor with increased protection from impacts and debris.

FIG. 3E shows a perspective view of the front sight of FIG. 3 and shows the light receptor (301) located in the front bore (305) of the front protrusion (304) and in the rear bore (303) of the rear protrusion (302) and positioned above the reflector (306).

Figure 4E:
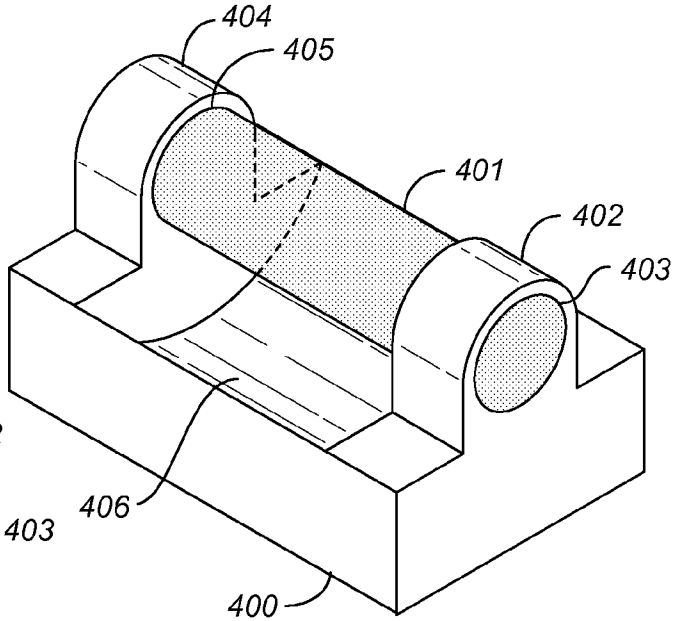
FIG. 4E is a perspective view of the front sight of FIG. 4.
Figure 4B:
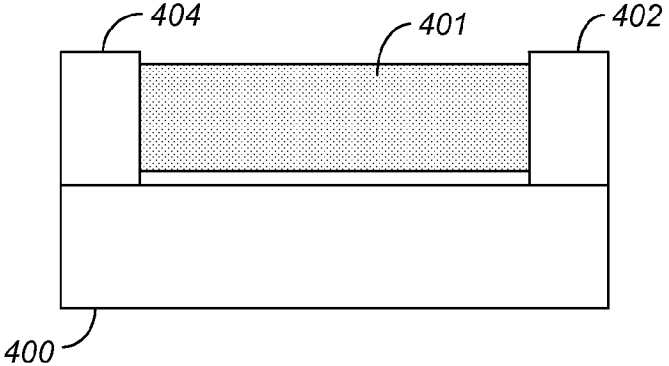
FIG. 4B is a side view of the front sight of FIG. 4.
Figure 4D:
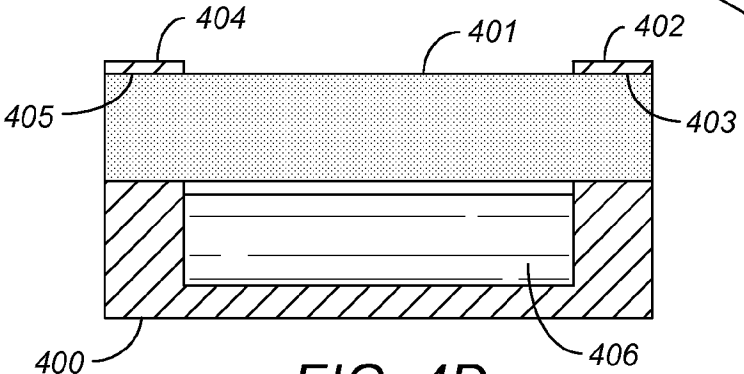
FIG. 4D is a longitudinal cross-sectional view of the front sight of FIG. 4.
Figure 4A:
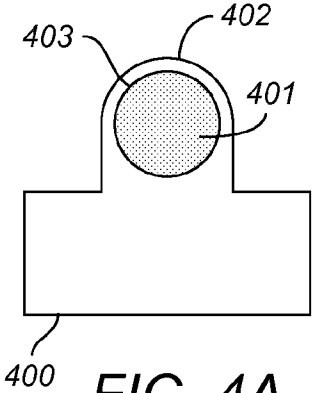
FIG. 4A is rear view of a front sight of another embodiment of the present invention.

Other embodiments of the present invention can provide a weapon sight for a bead-type front sight. Those embodiments can comprise a sight body, a light receptor coupled to the sight body, and a reflective surface that directs light to the light receptor. FIG. 4 shows one such embodiment. FIG. 4A shows a rear or shooter-facing view of the sight of FIG. 4, and shows a sight body (400) having a rear protrusion (402) and a light receptor (401) that can comprise a FO rod. The light receptor (401) is located in the rear bore (403) of the rear protrusion (402). FIG. 4B provides a side view of the embodiment of FIG. 4 and shows the sight body (400) including the rear protrusion (402) and the front protrusion (404). The FO rod (401) is shown coupled to the sight body (400) using the rear protrusion (402) and the front protrusion (404).

Figure 4C:
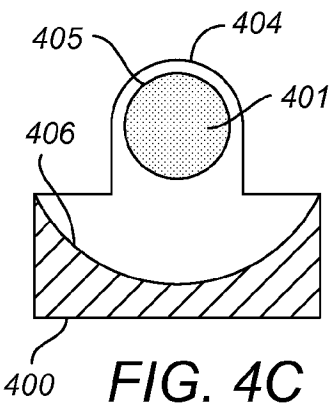
FIG. 4C is a lateral cross-sectional view of the front sight of FIG. 4.

FIG. 4C show a lateral cross-sectional view of the front sight of FIG. 4 as shown from the rear of the sight, and shows the light receptor (401) located in the front bore (405) of the front protrusion (404) and positioned above the reflector (406). FIG. 4D shows a longitudinal cross-sectional view of the front sight of FIG. 4 and shows the light receptor (401) located in the front bore (405) of the front protrusion (404) and in the rear bore (403) of the rear protrusion (402) and positioned above the reflector (406). FIG. 4E shows a perspective view of the front sight of FIG. 4 and shows the shows the light receptor (401) located in the front bore (405) of the front protrusion (404) and in the rear bore (403) of the rear protrusion (402) and positioned above the reflector (406).

As shown by way of example in FIGS. 3 and 4, a light receptor can have any suitable length, width, and shape in embodiments of the present invention. For example, a light receptor can be narrower, the same width as, or wider than, the sight body in various embodiments of the present invention. A shooter may prefer the narrower light receptors (101, 301) of FIGS. 1 and 3 for pistol or rifle shooting, for example, and the wider light receptor (401) of FIG. 4 for shotgun shooting, for example.

Figure 5B:
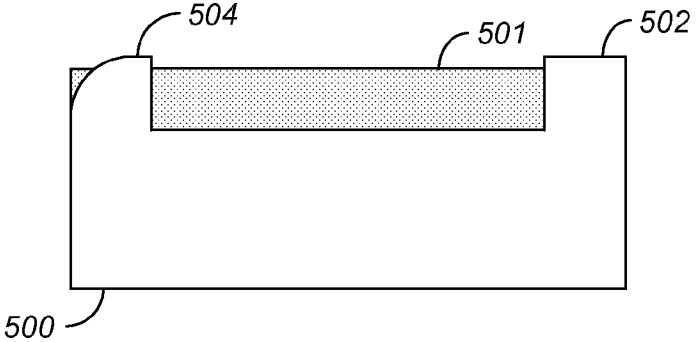
FIG. 5B is a side view of the front sight of FIG. 5.
Figure 5A:
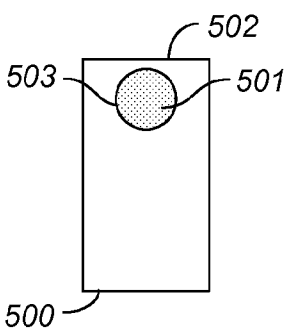
FIG. 5A is rear view of a front sight of another embodiment of the present invention.

The various embodiments of the present invention can include a reflector that has any suitable size and shape and that comprises one or more surfaces. The individual surfaces may be curved or flat. One embodiment utilizing flat surfaces is shown in FIG. 5. FIG. 5A shows a rear or shooter-facing view of the sight of FIG. 5, and shows a sight body (500) having a rear protrusion (502) and a light receptor (501) that can comprise a FO rod. The light receptor (501) is located in the rear bore (503) of the rear protrusion (502). FIG. 5B provides a side view of the embodiment of FIG. 5 and shows the sight body (500) including the rear protrusion (502) and the front protrusion (504).

The embodiment shown in FIG. 5 is similar to the embodiment shown in FIG. 1 except for the use of a multi-faceted, curved polygonal surface (506) that directs reflected light to the light receptor (501). FIG. 5C shows a lateral cross-sectional view of the front sight of FIG. 5 as shown from the rear of the sight, and shows the light receptor (501) located in the front bore (505) of the front protrusion (504) and positioned above the curved polygonal reflector (506). It can be envisioned with respect to FIG. 5C that the normal of each surface of the curved polygonal reflector (506) can point to the light receptor (501) so that the individual surfaces can direct reflected light to the light receptor (501).

Figure 5D:
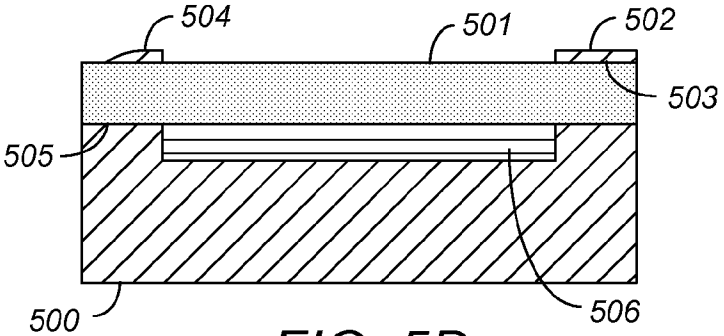
FIG. 5D is a longitudinal cross-sectional view of the front sight of FIG. 5.
Figure 5C:
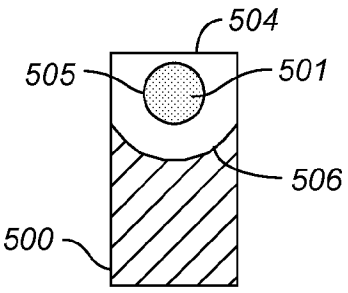
FIG. 5C is a lateral cross-sectional view of the front sight of FIG. 5.
Figure 5E:
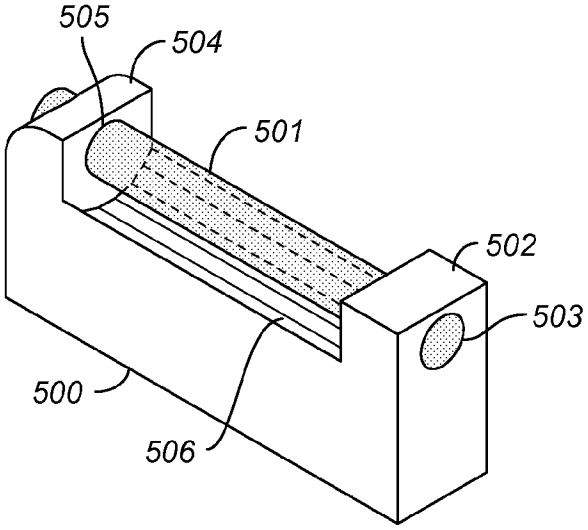
FIG. 5E is a perspective view of the front sight of FIG. 5.

FIG. 5D shows a longitudinal cross-sectional view of the front sight of FIG. 5 and shows the light receptor (501) located in the front bore (505) of the front protrusion (504) and in the rear bore (503) of the rear protrusion (502) and positioned above the curved polygonal reflector (506). FIG. 5E shows a perspective view of the front sight of FIG. 5 and shows the shows the light receptor (501) located in the front bore (505) of the front protrusion (504) and in the rear bore (503) of the rear protrusion (502) and positioned above the curved polygonal reflector (506).

As shown in FIG. 1, for example, a reflector (101) can comprise a curved surface, and as shown in FIG. 5, for example, a reflector (501) can comprise one or more flat surfaces. In further embodiments, a reflector can comprise one or more curved surfaces and one or more flat surfaces. Each reflective surface in embodiments of the present invention need not reflect light to a light receptor. For example, the vertical inner walls of the front (504) and rear (502) protrusions may be reflective and can reflect light to other surfaces, such as reflector (506), which can then further reflect said light to the light receptor (501). In addition to reflecting ambient light to a light receptor, the reflector of embodiments of the present invention can also reflect back to the light receptor light that has entered, but escaped, the receptor.

The light receptor of any embodiment of the present invention may be coupled to a sight base in any suitable way, such as by using one or more mounting points. For example, a front protrusion and a rear protrusion of a sight body can include front and rear mounting points. A mounting point can comprise a bore as shown in FIGS. 1-5. A bore can fully, or partially, encompass the circumference of a light receptor. A plurality of mounting points or bores can be used to secure a light receptor to a sight base. For example, FIGS. 1-5 show light receptors being secured to sight bases using two co-axial bores. The co-axial bores may be parallel to a long axis of the sight body, but need not be. For example, the bores may be co-axial, with the bore in the rear protrusion being higher in the sight body than the bore in the front protrusion. In other words, the axis established by two or more mounting points or bores can be parallel with, or at an angle to, a reflector and/or a sight body. In further embodiments a single bore, or three or more bores, can be used. A light receptor may be further affixed on a mounting point, or in a bore, using any suitable method such as a press fit, an adhesive, and/or by melting one or more ends of the light receptor. In further embodiments one or more bores may include a counterbore. A counterbore may be used to secure the melted ends of a plastic light receptor in a sight body and to provide a crisp, circular rod end for the emission of light.

The reflective surface of various embodiments can be shaped and/or positioned to adjust the amount of light that is directed to a light receptor. For example, as shown in FIGS. 1-4, the reflective surface can comprise a curved surface, such as a spherical reflector (106, 209, 210, 306, 406), that can focus light on a light receptor. The curved surface can also comprise a parabola. A curved surface that does not have a single focus can also be used, and said surface can be shaped such that at least some of its reflected light intersects a light receptor. In addition, and/or in the alternative, the reflective surface can comprise one or more flat surfaces as shown in FIG. 5. One or more of the flat surfaces can be positioned so that the normal of one or more of said surfaces intersects a light receptor.

There are several considerations that may be taken into account to increase the amount of light collected by the light receptor in embodiments of the present invention, such as the light receptors (101, 201, 202, 301, 401, 501) shown in FIGS. 1-5. First, for example, spherical reflectors (106, 209, 210, 306, 406) such as those shown in FIGS. 1-4 may have a spherical aberration whereby not all reflected rays actually pass through focus. Spherical aberration is an optical effect that occurs due to the increased refraction of light rays when they strike a spherical reflector near its edge, in comparison with those that strike nearer its center. Rays that impact the reflector nearer the edge pass beneath the focus. Second, a light receptor such as an FO rod best collects those rays that strike perpendicular or normal to the rod surface; a ray that strikes perpendicular to a surface is said to have a zero degree angle of incidence to that surface. Assuming that a focus (i.e., one-half of the radius) is at a center of a FO rod, for example, rays reflected from an edge of a spherical reflector may hit below the center of the rod and thus not be normal (i.e., will have a non-zero angle of incidence) to the surface of the rod. Accordingly, a focus may be adjusted upwards, such as by being placed between the center and top of a FO rod, to increase the number of reflected rays that strike perpendicular, or nearly perpendicular, to the surface of the rod and thereby increase the light collected by the rod. For example, for a given spherical aberration x measured as a distance an aberrant ray, such as from an outer edge of a spherical reflector, passes below a focus, the intersection of the focus and the rod can be adjusted to account for the aberration. For example, the focus can be placed some value less than or equal to x, such as ½x, above the center of the FO rod. A focus may also be determined by using an optical model of the weapon sight and/or numerically, for example, by determining the focus that results in the lowest aggregate angle of incidence on the FO rod for all reflected rays.

The light receptor of embodiments of the present invention, such as the light receptors (101, 201, 202, 301, 401, 501) shown in FIGS. 1-5, can comprise any suitable material such as plastic or glass. The light receptor can have any suitable shape, but is preferably a round rod. The light receptor can be of any suitable color such as red, green, orange, or yellow. The light receptor can comprise any suitable width such as 0.02, 0.04, 0.06, 08, 0.09, 0.1, 0.11, 0.12 or 0.125 inches, or 0.5, 1, 1.5, 2, 2.5, or 3 millimeters in diameter, for example. In preferred but non-limiting embodiments the light receptor can comprise a plastic fluorescent or scintillating fiber rod. A suitable scintillating fiber rod is the OPTIBRIGHT® scintillating fiber obtainable from Poly-Optical Products, Inc. OPTIBRIGHT® scintillating fibers consist of a polystyrene-based core and a polymethyl methacrylate ("PMMA") cladding. The core contains a combination of fluorescent dopants selected to produce the desired scintillation and optical qualities. Scintillating fibers "collect" or absorb light from their surroundings and emit light at the rod ends. Non-scintillating fibers may also be used in embodiments of the present invention.

The reflector of embodiments of the present invention, such as reflectors (106, 209, 210, 306, 406, 506) shown in FIGS. 1-5, can be formed in a number of suitable ways. In general, a more reflective surface may direct more light to a light receptor and thus result in a brighter weapon sight. The reflective surface can comprise at least one of plastic, glass, ceramic, and metal. The reflective surface can comprise a polished surface of the weapon sight body or it can comprise a separate part, such as a reflector body, that is permanently affixed to, or detachably coupled to, the weapon sight. By way of one example, a reflective surface can be machined into the sight and made reflective by polishing, such as when the weapon sight is made of a metal like steel, aluminum, or brass. In those embodiments the metal chosen, such as a stainless steel or aluminum alloy, preferably forms a transparent or semi-transparent oxidation layer that will resist corrosion. In further embodiments a reflective coating, layer, tape, plating, or treatment can be used to provide a reflective surface. For example, in one embodiment the reflective surface can comprise metallic plating such as a nickel, titanium, silver, or chrome plating. The plating may be polished to further increase its reflectivity. In yet other embodiments the reflective surface can comprise a reflective metallized tape, such as metallized biaxially-oriented polyethylene terephthalate or MYLAR® tape.

The weapon sight body of embodiments of the present invention, such as bodies (100, 200, 300, 400, 500) shown in FIGS. 1-5, can be made from any suitable material such as metals including iron, iron alloys, steel, aluminum, aluminum alloys, brass, titanium, or a plastic or ceramic, and any combination thereof. The weapon sight body of embodiments of the present invention can be made in any suitable way such as by machining, casting, printing, and metal injection molding.

The weapon sight embodiments of the present invention, such as those described with respect to FIGS. 1-5, can be attached to a weapon in any suitable way including by the use of a screw, dovetail, press fit, magnet, clamp, and/or pin. In further embodiments, the weapon sight can be integrated into a weapon. For example, the front-sight embodiments of the present invention, such as those described with respect to FIGS. 1 and 2-5, can be machined into a weapon slide, receiver, or barrel such that the weapon slide, receiver, or barrel and sight are made from a single piece of metal. Similarly, the rear-sight embodiments of the present invention, such as those described with respect to FIG. 2, can be machined into a weapon slide, receiver, or barrel, for example.

As used herein, the word "means" is intended to trigger 35 U.S.C. §112, paragraph 6, unless expressly noted otherwise. Accordingly, by way of example only, a "body means" corresponds to at least those sight bases or bodies (100, 200, 300, 400, 500) disclosed with respect to FIGS. 1-5; a "receptor means" corresponds to at least those light receptors (101, 201, 202, 301, 401, 501) disclosed with respect to FIGS. 1-5; a "reflector means" corresponds to at least those reflectors (106, 209, 210, 306, 406, 506) disclosed with respect to FIGS. 1-5; and a "protrusion means" corresponds to at least those protrusions (102, 104, 203, 204, 211, 212, 302, 304, 402, 404, 502, 504) disclosed with respect to FIGS. 1-5.

Figure 6:
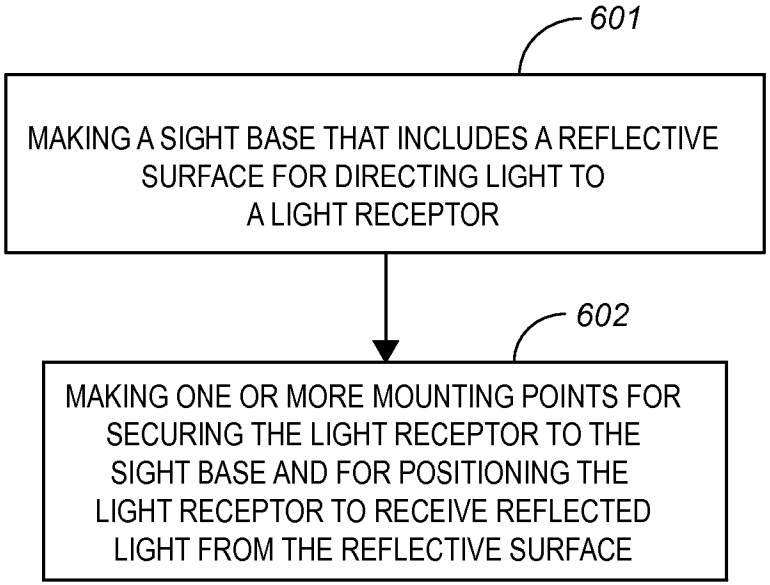
FIG. 6 illustrates a method of one embodiment of the present invention for manufacturing a weapon sight.

A further embodiment of the present invention as shown in FIG. 6 provides a method for manufacturing a weapon sight. The method can first comprise the step of making (601) a sight base that includes a reflective surface for directing light to a light receptor. Step 601 can be used to make any of the sight bases described herein, including, but not limited to, the sight bases (100, 200, 300, 400, 500) described with respect to FIGS. 1-5, and any of their related embodiments. Similarly, the reflective surface of any embodiment of the present invention can be made by step 601, including, but not limited to, the reflective surfaces (106, 209, 210, 306, 406, 506) described with respect to FIGS. 1-5, and any of their related embodiments.

Second, the method can comprise the step of making (602) one or more mounting points for securing the light receptor to the sight base and for positioning the light receptor to receive reflected light from the reflective surface. The one or more mounting points can comprise any of the ways for securing a light receptor to a sight base described herein, including, but not limited to, the mounting points described with respect to FIGS. 1-5, and any of their related embodiments. The steps of the embodiment of FIG. 6 need not be performed in any particular order.

The method of FIG. 6 can further comprise the step of securing the light receptor to the sight base using the one or more mounting points. The light receptor can comprise any of the light receptors described herein, including, but not limited to, the light receptors (101, 201, 202, 301, 401, 501) described with respect to FIGS. 1-5, and any of their related embodiments.

Figure 7:
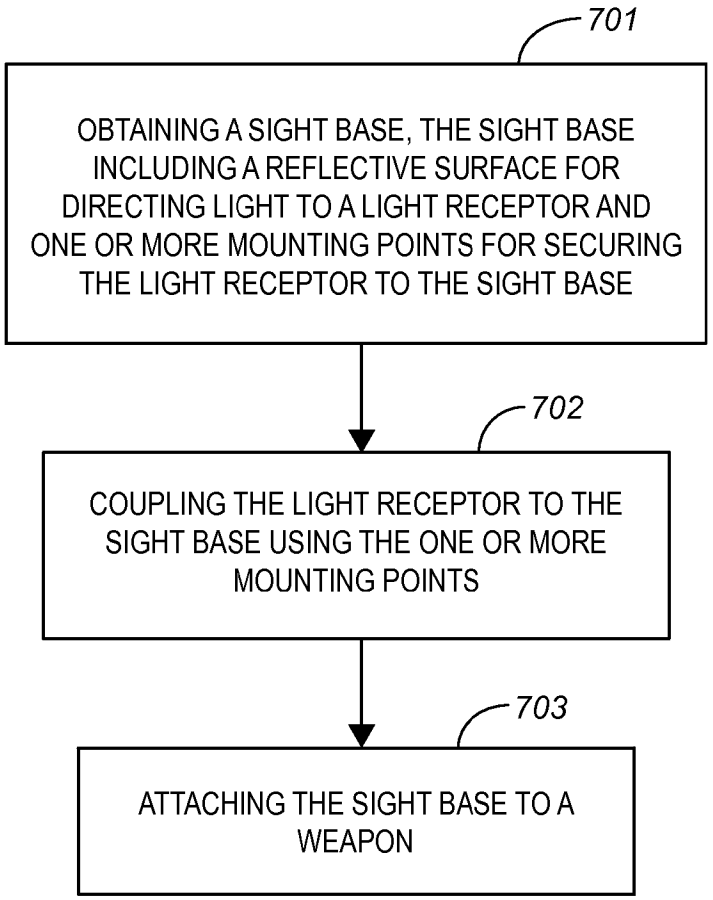
FIG. 7 illustrates a method of one embodiment of the present invention for installing a weapon sight.

Another embodiment of the present invention as shown in FIG. 7 provides a method for installing a weapon sight. The method can first comprise the step of obtaining (701) a sight base, the sight base including a reflective surface for directing light to a light receptor and one or more mounting points securing the light receptor to the sight base.

Step 701 can be used with any of the sight bases described herein, including, but not limited to, the sight bases (100, 200, 300, 400, 500) described with respect to FIGS. 1-5, and any of their related embodiments. The reflective surface of any embodiment of the present invention can be used with step 701, including, but not limited to, the reflective surfaces (106, 209, 210, 306, 406, 506) described with respect to FIGS. 1-5, and any of their related embodiments. The light receptor referred to by step 701 can comprise any of the light receptors described herein, including, but not limited to, the light receptors (101, 201, 202, 301, 401, 501) described with respect to FIGS. 1-5, and any of their related embodiments. Similarly, the one or more mounting points can comprise any of the ways for securing a light receptor to a sight base described herein, including, but not limited to, the mounting points described with respect to FIGS. 1-5, and any of their related embodiments. Second, the method can further comprise the steps of coupling (702) the light receptor to the sight base using the one or more mounting points. Third, the sight base can be attached (703) to a weapon.

One of skill in the art will understand that the features of the weapon sights, apparatuses, and systems of the present invention, as well as of the steps of the methods of the present invention, may be used together to create further embodiments of the present invention. While the invention has been described in detail in connection with specific embodiments, it should be understood that the invention is not limited to the above-disclosed embodiments. Rather, a person skilled in the art will understand that the invention can be modified to incorporate any number of variations, alternations, substitutions, or equivalent arrangements not heretofore described, but which are commensurate with the spirit and scope of the invention. Specific embodiments should be taken as exemplary and not limiting.

I claim:

1. A weapon sight comprising:

a. a sight body;

b. a rear protrusion coupled to the sight body and including a rear bore;

c. a front protrusion coupled to the sight body and including a front bore;

d. a fiber optic rod coupled to the sight body using the rear bore and the front bore, wherein the fiber optic rod has a diameter of between one and two millimeters, inclusive; and e. a concave reflector, having a spherical aberration, that is located between the rear protrusion and the front protrusion and that has a focus, and wherein the focus is positioned a distance above a center of the fiber optic rod that is less than or equal to the spherical aberration of the reflector such that light reflected from an edge of the reflector strikes the fiber optic rod and thereby increases the amount of reflected light collected by the fiber optic rod.

2. The weapon sight of claim 1, wherein the concave reflector comprises a cylindrical spherical reflector.

3. The weapon sight of claim 2, wherein the weapon sight comprises an open-type front sight.

4. The weapon sight of claim 2, wherein the concave reflector comprises one of a reflective coating, layer, tape, and plating.

5. The weapon sight of claim 2, further comprising a reflector body that is coupled to the sight body, and wherein the concave reflector is located on a surface of the reflector body.

6. The weapon sight of claim 2, wherein the weapon sight comprises an open-type rear sight.

7. The weapon sight of claim 6, wherein the concave reflector comprises one of a reflective coating, layer, tape, and plating.

8. The weapon sight of claim 6, further comprising a reflector body that is coupled to the sight body, and wherein the concave reflector is located on a surface of the reflector body.

9. The weapon sight of claim 2, wherein the concave reflector comprises one of a reflective coating, layer, tape, and plating.

10. The weapon sight of claim 9, further comprising a reflector body that is coupled to the sight body, and wherein the concave reflector is located on a surface of the reflector body.

11. The weapon sight of claim 2, further comprising a reflector body that is coupled to the sight body, and wherein the concave reflector is located on a surface of the sight body.

12. The weapon sight of claim 11, wherein the weapon sight comprises an open-type front sight.

13. The weapon sight of claim 12, wherein the concave reflector comprises one of a reflective coating, layer, tape, and plating.

14. The weapon sight of claim 12, further comprising a reflector body that is coupled to the sight body, and wherein the concave reflector is located on a surface of the reflector body.

15. The weapon sight of claim 1, wherein the weapon sight comprises an open-type rear sight.

16. The weapon sight of claim 15, wherein the concave reflector comprises one of a reflective coating, layer, tape, and plating.

17. The weapon sight of claim 15, further comprising a reflector body that is coupled to the sight body, and wherein the concave reflector is located on a surface of the reflector body.

18. The weapon sight of claim 1, wherein the concave reflector comprises one of a reflective coating, layer, tape, and plating.

19. The weapon sight of claim 18, further comprising a reflector body that is coupled to the sight body, and wherein the concave reflector is located on a surface of the reflector body.

20. The weapon sight of claim 1, further comprising a reflector body that is coupled to the sight body, and wherein the concave reflector is located on a surface of the reflector body.

* * * * *